US005846060A

United States Patent [19]

Yoshimoto et al.

[11] Patent Number: 5,846,060

[45] Date of Patent: Dec. 8, 1998

[54] RECIPROCATING PISTON PUMP WITH BLEED PASSAGES

[76] Inventors: Ernesto Y. Yoshimoto, Calle 6, M 2 Lot 2, Santa Patricia, Lima, Peru; Carlos Y. Yoshimoto, 184 Ironwood Dr., Martinez, Calif. 94553

[21] Appl. No.: 511,044

[22] Filed: Aug. 3, 1995

Related U.S. Application Data

[63] Continuation-in-part of Ser. No. 276,287, Jul. 18, 1994, abandoned.

[51] Int. Cl.[6] ..... F04B 49/00

[52] U.S. Cl. ..... 417/284; 417/297; 417/311; 417/552; 417/557

[58] Field of Search ..... 417/283, 284, 417/288, 290, 296, 297, 299, 307, 311, 552, 557, 567, 569; 137/540, 543.19, 903

[56] References Cited

U.S. PATENT DOCUMENTS

| | | | |
|---|---|---|---|
| 989,883 | 4/1911 | Snee | 417/284 |
| 1,156,657 | 10/1915 | Beam | 417/284 |
| 1,177,035 | 3/1916 | Humphrey et al. | 417/284 |
| 1,831,411 | 11/1931 | Dietz | 417/569 |
| 2,057,624 | 10/1936 | Burkhart | 417/557 |
| 2,136,636 | 11/1938 | Rotter | 417/557 |
| 2,322,120 | 6/1943 | Erickson | 417/557 |
| 2,804,241 | 8/1957 | McDowall et al. | 417/557 |
| 3,771,908 | 11/1973 | Rosen | 417/557 |
| 4,538,970 | 9/1985 | Rabson | 417/557 |

FOREIGN PATENT DOCUMENTS

| | | | |
|---|---|---|---|
| 1657736 | 6/1991 | U.S.S.R. | 417/284 |

*Primary Examiner*—Richard A. Bertsch
*Assistant Examiner*—Ted Kim
*Attorney, Agent, or Firm*—Jack C. Munro

[57] ABSTRACT

A pump which has a piston (30) which is reciprocatingly moved vertically inside a tubular housing (32) to extract fluid from the bottom of a well (29). The piston (30) is attached to a motor (12) for driving it and has a horizontally extending base plate (50) with a central opening (52) provided with a plug (64) functioning as a check valve. As the fluid is pumped, the plug (64) is raised and the fluid flows into a high pressure reservoir (35) above the base plate (50). When the pressure inside the reservoir (35) exceeds a specified level, the base plate (50) is moved downward against an upward biasing force. This opens an annular port (51) exposing bleed ducts (56) and allows some of the fluid in the reservoir (35) to flow back into low pressure chamber (37) located below the base plate (50). Grooves (43) are also provided on the peripheral surface of base plate (50) for allowing small amounts of fluid to continuously escape from the reservoir (35) as long as the fluid pressure in the reservoir (35) is higher than in the low pressure chamber (37). This allows the pump to idle at the start-up and hence starts the pump smoothly as well as preventing overpressure conditions.

6 Claims, 3 Drawing Sheets

RECIPROCATING PISTON PUMP WITH BLEED PASSAGES

REFERENCE TO PRIOR APPLICATION

This application is a continuation-in-part of U.S. patent application Ser. No. 08/276,287 filed Jul. 18, 1994, now abandoned by the same title and the same inventors.

BACKGROUND OF THE INVENTION

1) Field of the Invention

The field of this invention relates to pumps and more particularly to a reciprocating piston pump which is to be usable to extract a liquid from a well within the ground.

2) Description of the Prior Art

The Reciprocating piston pumps which alternately raise and lower a piston relative to a well to extract water or other fluids therefrom are well known. Although such pumps may be operated manually, motors are also commonly used to power such pumps through the intermediary of the output shaft of the motor to a vertically oriented reciprocating motion by using a driving rod or the like.

In order to convert an alternate up and down motion of a piston inside a pump into a unidirectional fluid flow, at least two check valves are required, one being situated at the inlet port of the pump to control the fluid flow from a low pressure fluid source and the other being operatively associated with the piston to control the discharge of the fluid at high pressure. As the piston is lowered into the fluid at the bottom of a well, the first (or lower) check valve is forced to close. The second (or upper) check valve remains open until the pressure of the fluid on top of the valve exceeds the inlet pressure. The second valve then closes and traps the fluid inside the reservoir. The piston is then raised until the pressure inside the housing is sufficiently high to discharge its content through the outlet port, and the first (or lower) check valve is forced open to admit fluid into a chamber defined below the piston.

U.S. Pat. No. 412,211 issued Oct. 1, 1889 disclosed a well cleaner operating in this manner, depicting a pair of vertically oriented rods situated on opposite sides of a cylinder which is sealed at its bottom by a wall, while its top is open. A vertically oriented handle is secured to the upper end of the cylinder for raising and lowering it. A piston is provided inside the cylinder, and the cylinder is drawn upward to create a vacuum inside the cylinder, and the outside pressure forces open a valve on the bottom wall such that the content of the well can enter the cylinder rapidly. The piston then seals the cylinder and is drawn to the surface of the well.

Although reciprocating piston pumps with conventional check valves have widely been in use, there are many problems associated with such pumps. These problems seriously limit the useful life as well as the effectiveness of the pump, particularly where the pump is driven by a motor which is not carefully matched to the capacity of the pump.

The design stress limits for prior art piston pumps fall in a narrow range, and structure failures result when excessive and/or uncontrollable power source, such as wind power, is used to drive the pump. The pressure within the pump increases exponentially with the speed, that is, the reciprocating frequency of the driving rod. Consequently, even a relatively small increase in reciprocating frequency is reflected by a much larger increment in pressure within the pump.

Relief valves have been used as safety measures to allow the excessive pressure build-up to be prevented. These valves, however, have not always functioned properly. The tendency to develop excessively high pressures within reciprocating pumps still persists.

When the power source is deficient, furthermore, such as during a lull period of no wind for a windmill, and the reciprocating frequency of the driving rod drops to a low level or even to zero, prior art piston pumps do not function well under start-up conditions. Consequently, significant time and effort must be devoted to start up reciprocating movement of prior art piston pumps and to bring it up to a satisfactory operating speed and/or pressure.

SUMMARY OF THE INVENTION

It is an object of this invention to provide a reciprocating piston pump which can start up smoothly to reach a satisfactory operating speed and/or pressure.

It is an additional object of the invention to provide such a reciprocating piston pump which is small in size and can be quickly and easily installed.

Another objective of this invention is to construct a reciprocating piston pump driven by a mechanical power source, such as a motor, and operable over a wide range of speeds.

Another objective of this invention is to utilize a multi-function valve assembly operably associated with a piston of such a pump that functions satisfactorily over a wide range of speed while controlling pressure build-up within the pump housing thereby averting overpressure conditions.

A reciprocating piston pump having a piston which is vertically movable inside a tubular casing where the piston comprises a tubular member. The piston has a base plate which extends horizontally and is movable with respect to this tubular member. The base plate separates the interior of the casing into an upper reservoir and a lower chamber and itself has a central opening equipped with a plug which functions as a check valve of an ordinary kind. Bleed ducts for fluid are formed through the tubular member and also between the tubular member and the base plate. Biasing means, such as an elastomeric ring or a spring, is provided so as to normally keep the base plate pressed against the tubular member. When an overpressure condition is reached in the upper reservoir, the base plate is moved against the elastomeric ring forming an annular opening permitting fluid to pass through the annular opening about the periphery of the base plate. The bleed ducts between the base plate and the tubular member comprise grooves formed in the periphery of the base plate to allow small amounts of fluid to escape from the upper reservoir to the lower chamber. This allows the pump to idle at the start-up and hence starts the pump smoothly as well as preventing overpressure conditions.

DETAILED DESCRIPTION OF THE PREFERRED EMBODIMENT

Figure 1:
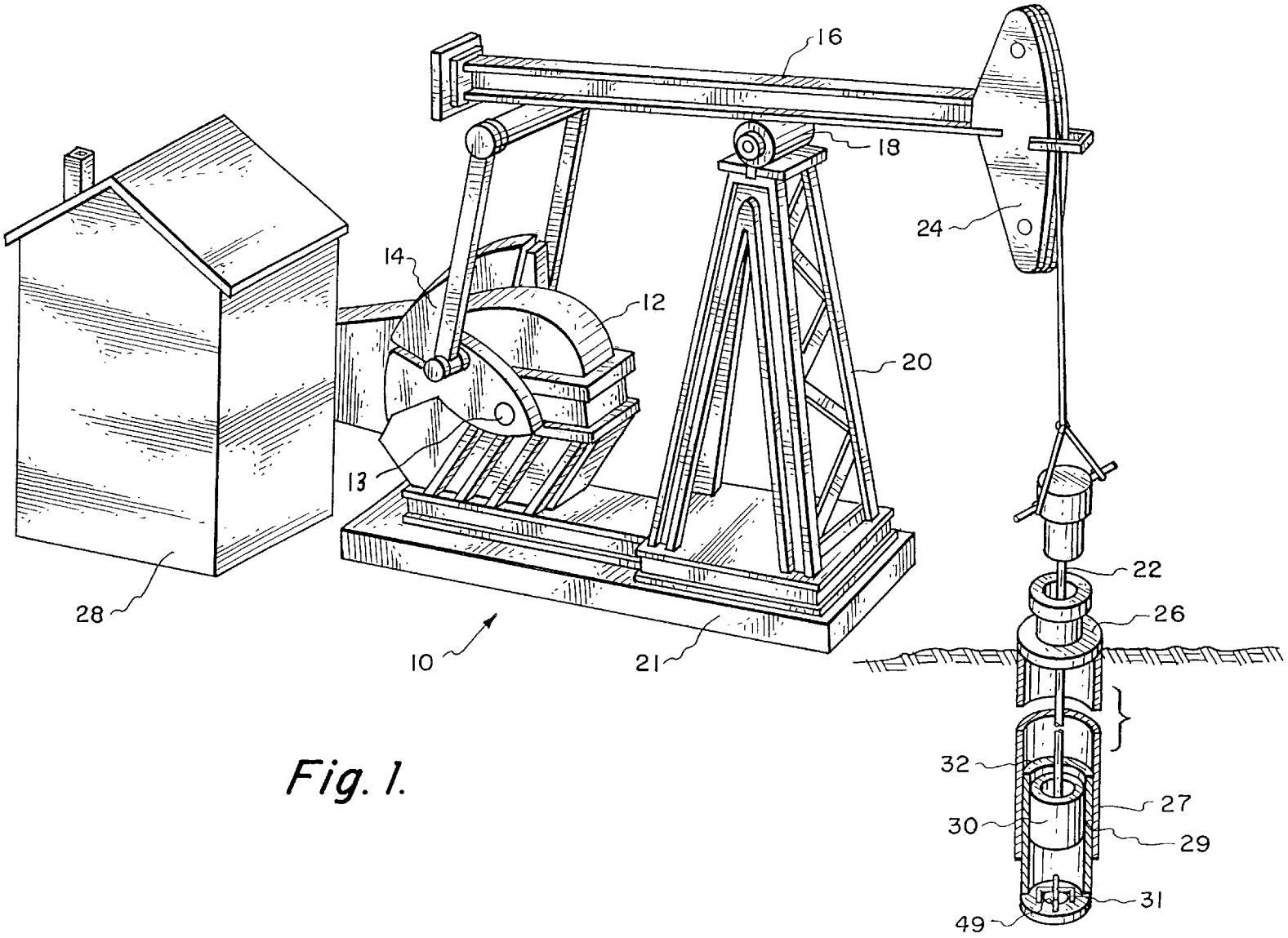
FIG. 1 is a schematic pictorial representation of a well pumping station which may use a pump according to the present invention.

FIG. 1 shows a system 10 for using a pump according to the present invention, including a motor 12 such as an electric motor, a crank mechanism 14 coupled to the output shaft 13 of the motor 12 to convert its rotational output into reciprocating linear motion, and a "walking beam" or lever 16 pivotally mounted on bearing 18 on top of a tower 20 with a base 21 which supports the system 10. Connected between the crank mechanism 14 and level 16 is linkage 15. The bearing 18 serves as a fulcrum for the lever 16. A vertically extending drive rod 22 is suspended from head 24 at the outer end of the lever 16. The rod 22 extends downward through a cap 26 into a well casing 27 located within a well 29. The rod 22 is driven in a reciprocating manner, alternately upward and downward, so as to extract water, oil, slurry, etc. at the bottom of the well 29. The distance of travel by the rod 22, or its stroke, is controlled by the position of the bearing 18, while the frequency of the reciprocating motion of the rod 22 is measured in cycles per minute and is controlled by the rotational speed of the motor 12. Operational controls of the motor 12 or the system 10 as a whole may be maintained within an enclosure 28.

Figure 2:
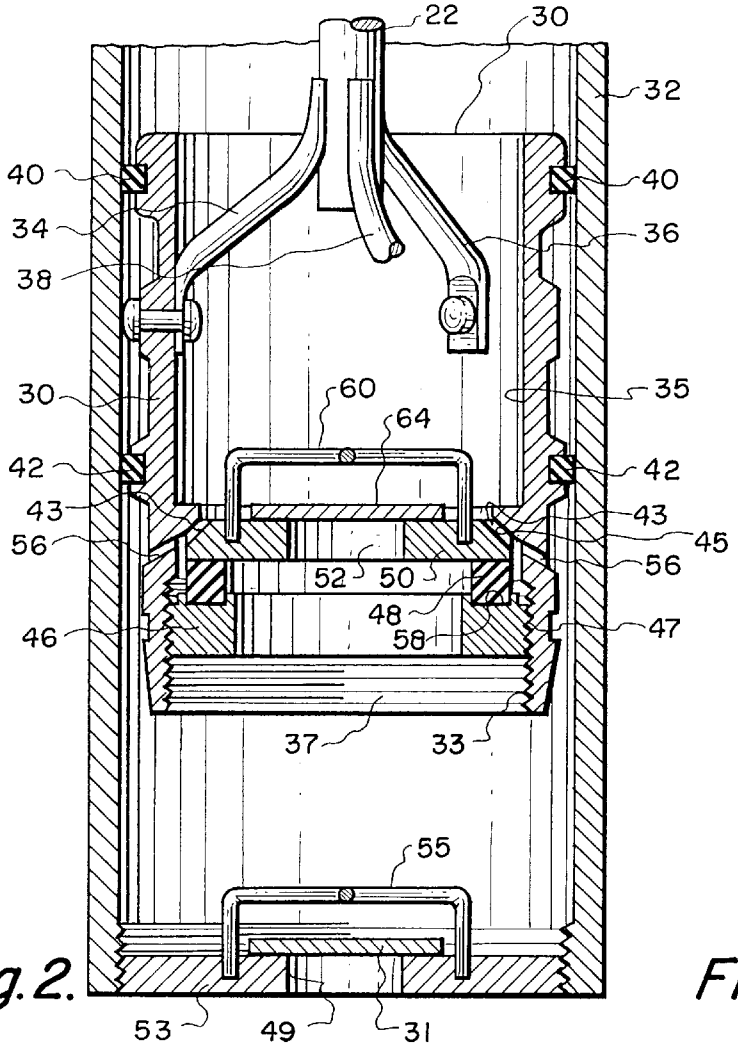
FIG. 2 is a vertical sectional view of a pump embodying the invention showing the pump in a stationary position.
Figure 5:
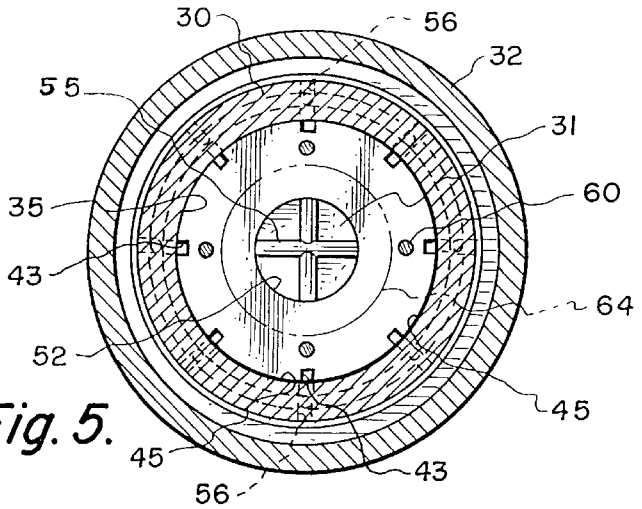
FIG. 5 is a cross sectional view taken along line 5—5 of FIG. 4.

FIG. 2 shows a pump embodying the invention, having a piston 30 adapted to move vertically within a tubular housing 32. The piston 30 is cylindrical and open at its upper and lower ends. The driving rod 22 extends into the upper end of the piston 30 along its longitudinal axis, and is secured to the piston 30 by three legs 34, 36 and 38. The open ends of the legs 34, 36 and 38 are welded to the driving rod 22 with their lower ends riveted to the piston 30. The piston 30 fits inside the housing 32 and has annular seals 40 and 42 seated in grooves formed on the external surface of the piston 30. The seals 40 and 42 permit sliding movement of piston 30 relative to housing 32, while maintaining a substantially fluid tight connection therebetween.

The piston 30 and housing 32 is intended to be lowered into the well casing 27 of the well 29 until it is at least partially submerged in a body of fluid to be extracted. A check valve 31 of a conventional type, located at the inlet of the housing 32, allows the fluid to flow into the housing 32 from below the check valve 31. The housing 32 is intended to fit within the cylindrical well casing 27 of the well 29.

The lower end of the piston 30 has internal threads 33. An annular nut 46 with external threads 47 is engaged with internal threads 33 so as to be able to vary the axial position with respect to the piston 30. A resilient elastomeric ring 48 is sandwiched between the annular nut 46 and the bottom surface of a base plate 50 which has a large central opening 52. Elastomeric ring 48 nests within annular pocket 58 formed on annular nut 46. Base plate 50 extends transversely or laterally across the interior of the piston 30. The base plate 50 serves to separate the interior of piston 30 into a high pressure reservoir 35 and a low pressure chamber 37. High pressure reservoir 35 is located above low pressure chamber 37.

Figure 3:
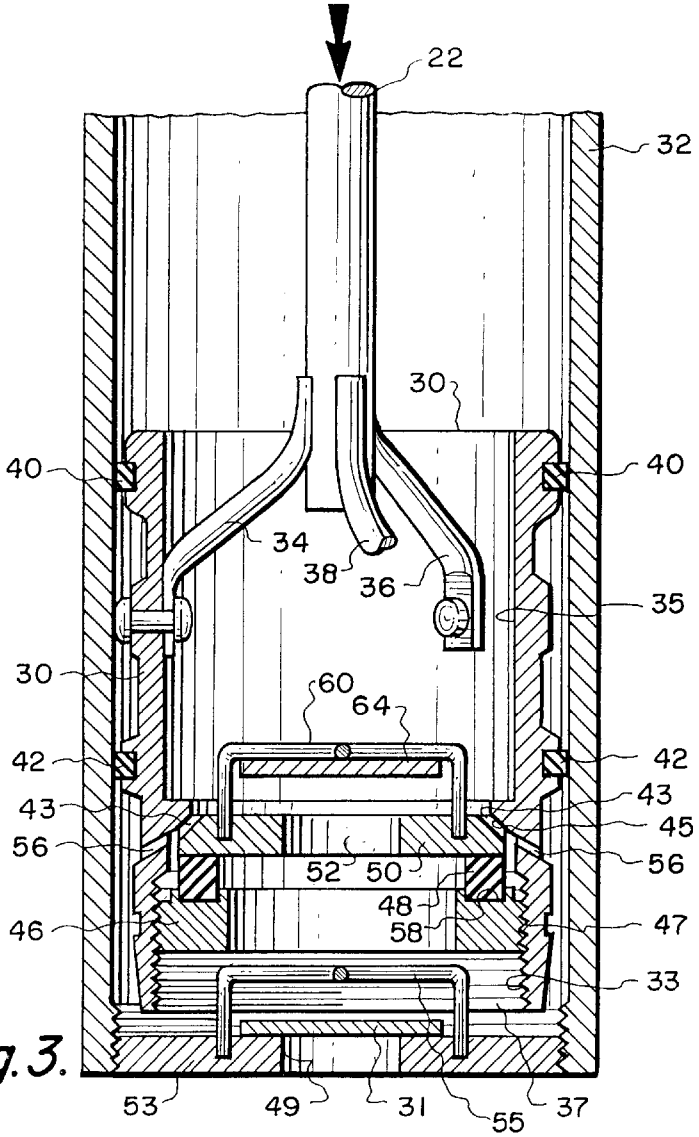
FIG. 3 is a vertical sectional view of the pump of FIG. 2 showing the position of the piston when the pump is being moved downward into the well.

Bleed ducts 56 are provided through the sidewall of the piston 30. There will normally be between four to eight in number of bleed ducts 56. The base plate 50 is adapted to normally substantially block fluid communication between the high pressure reservoir and the low-pressure chamber 37. However, included in the periphery of base plate 50 are a plurality (usually eight in number) of grooves 43. These grooves 43 are equiangularly spaced apart. These grooves 43 are no more than a few thousandths of an inch in diameter. Fluid continuously flows through these grooves 43 as long as there is a higher pressure in high pressure reservoir 35. A cage 60, formed of wires or rods, is attached to the upper surface of the base plate 50, covering its central opening 52, such that a plug 64 for closing the opening 52 can move upwards to unplug the opening 52 but its upward motion will be limited by the cage 60 as is shown in FIG. 3.

The flow of the fluid through the grooves 43 enables the piston 30 to idle at start-up, or when the motor 12 is operating the drive rod 22 at a very low speed. When speed of motor 12 is increased, pumping occurs even through there is leakage through grooves 43. The diameter of grooves 43 is preselected to produce pumping of fluid when the operating frequency is about twenty strokes per minute of the driving rod 22.

When the piston 30 is on its upward stroke, pumping of fluid from the well 29 occurs. Also, the check valve 31 is unseated by suction from opening 49 with check valve 31 moving up against cage 55. Fluid thus flows from the well 29 into low pressure chamber 37. As soon as the upward stroke ends, the check valve 31 will fall against plate 53 closing opening 49. As the piston 30 begins its downward stroke, the plug 64 is immediately unseated. As the piston 30 continues to move downward, water flows from the low pressure chamber 37 past unseated plug 64 into high pressure chamber 35. This movement of the water continues until the piston 30 reaches the bottom dead center position at which time the upward stroke is initiated.

Figure 4:
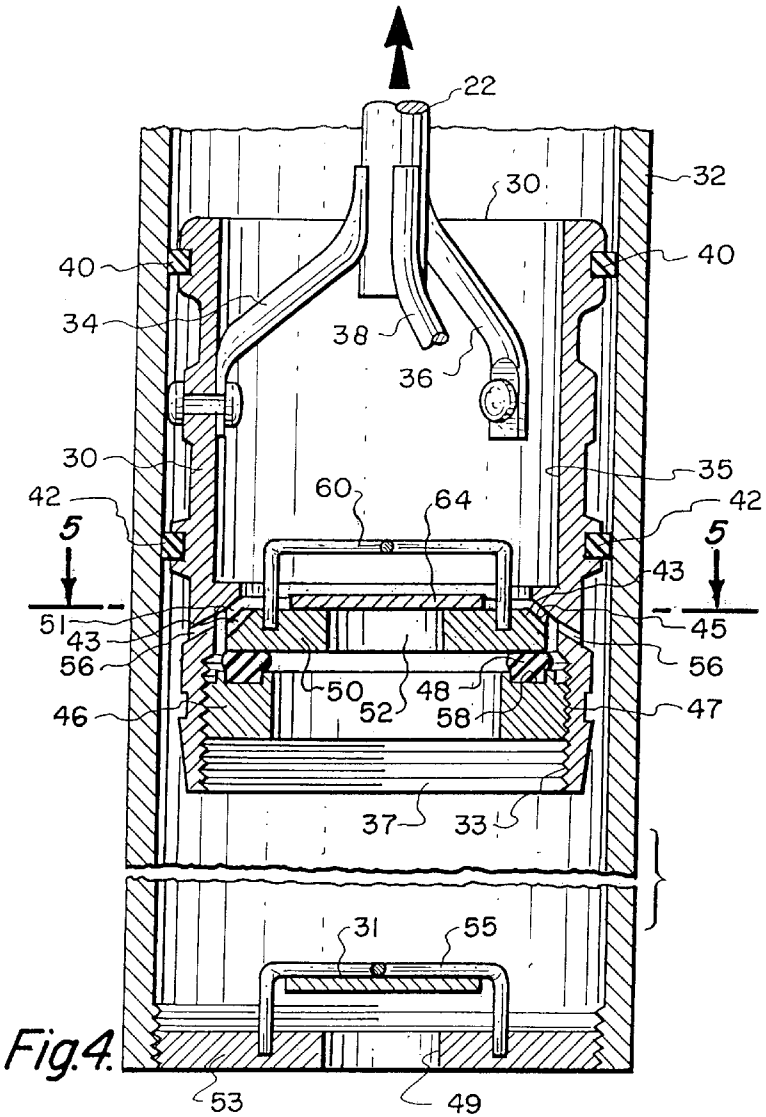
FIG. 4 is a vertical sectional view of the pump in FIG. 2 in an overpressure condition which occurs when the pump is moving upward in a direction away from the bottom of the well.

The pressure inside reservoir 35 above the base plate 50 increases rapidly with each cycle of motion of the driving rod 22. The pressure increases exponentially with the speed of the motor 12, for example, when the motor speed exceeds 80 rpm. When an overpressure condition develops inside the reservoir 35, the fluid pressure on the base plate 50 causes compressing of the elastomeric ring 48 so as to expose the bleed ducts 56, while the plug 64 keeps the central opening 52 of the base plate 50 firmly closed. The extent of the thrust of the ring 48 can be adjusted by moving the position of the threaded ring nut 46. The tighter threaded ring nut 46 is forced against elastomeric ring 48, the greater the overpressure required to unseat base plate 50. In other words, when the pressure inside the reservoir 35 exceeds a certain maximum level, the base plate 50 is forced downwards to compress the ring 48, which yields sufficiently to allow the base plate 50 to move forming annular port 51 and to expose the bleed ducts 56 as shown in FIG. 4, allowing the fluid to flow quickly around base plate 50, thereby reducing the pressure level. After the pressure level inside the reservoir 35 returns to normal, the elastic force of the ring 48 restores the ring to its normal shape, and the base plate 50 is pushed upward in contact with seat 45 of piston 30. The fluid which is vented through the bleed ducts 56 is returned to the lower pressure chamber 37 below the base plate 50. The elastomeric ring 48 also serves to absorb some of the momentary pressure surges encountered within the pump, imparting a damping force to prevent transient pressure waves from traveling through the piston 30 to the pump housing 32. The axial force of the resilient ring 48, and hence the critical pressure at which the base plate 50 begins to move downward, can be adjusted by moving the threaded ring 46.

In summary, a pump according to the present invention can be made compact and efficient such that the aforementioned problem of mismatching between the motor and the pump, frequently encountered with prior art reciprocating piston pumps, can be obviated because the multi-function valve assembly used by pumps according to the invention is configured to compensate for such mismatching. Thus, pumps according to the invention can start up easily and operate satisfactorily over extended ranges of operating speed and pressure.

Figure 6:
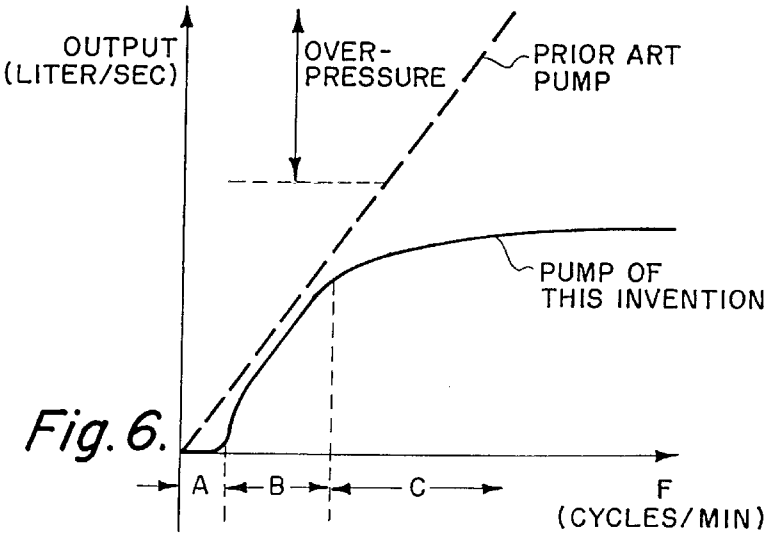
FIG. 6 is a graph of the output fluid flow against the frequency of the reciprocating motion for a prior art pump and the pump embodying the present invention.

FIG. 6 is a graph for demonstrating the advantages of the pump of the present invention. In a start-up condition (indicated by letter A in FIG. 6), when the reciprocating frequency F is between 0 and about 20 cycles/minute, prior art pumps will generally require a high pressure when the output tube is full of fluid. Pumps according to the present invention, by contrast, can start smoothly, and almost freely, because the grooves 43 in conjunction with bleed ducts 56, allow small amounts of fluid to return to the low pressure chamber 37 below the base plate. In other words, pumps according to this invention will not lift fluid under this condition.

In a pumping condition (indicated by letter B in FIG. 6), when the reciprocating frequency F may be, for example, between about 20 and 50 cycles/minute, both prior art pumps and pumps according to this invention work equally well. When an overpressure condition (indicated by letter C in FIG. 6) occurs at about 50 cycles/minute or over, prior art pumps may cause serious damage to the tubular housing 32. With pumps according to the present invention, by contrast, any dangerously excessive pressure is vented to the low pressure chamber 37 and safe operation is ensured.

What is claimed is:

1. A reciprocating piston pump comprising:

a tubular housing having a lower end positioned within a fluid source having an upper end for discharging fluid withdrawn from said source;

a bottom check valve located at said lower end of said tubular housing for selectively allowing fluid to flow from said source into said tubular housing retaining fluid within said housing;

a piston mounted within said tubular housing, said piston being reciprocatingly movable inside said tubular housing, said piston comprising:

an open ended tube;

a base plate having an opening therethrough and extending horizontally inside said open ended tube dividing said open ended tube into an upper high pressure reservoir and a low pressure chamber inside tubular housing;

a plug for normally blocking fluid flow through said opening; and biasing means for applying a biasing force on said base plate tending to keep said base plate at a closed position where said base plate substantially blocks fluid flow from said upper high pressure reservoir to said low pressure chamber, said base plate having a peripheral surface, said peripheral surface being seated against said tubular housing when in said closed position, a plurality of grooves formed within said peripheral surface for allowing leakage of fluid from said high pressure reservoir into said low pressure chamber with said base plate closed, whereby said piston must be moved at a sufficient level of cycles per minute in order for pumping to occur.

2. The pump of claim 1 wherein:

said piston further includes sealing means for slidably sealing said piston relative to the space between said tubular housing.

3. The pump of claim 1 wherein:

said piston further comprises cage means attached to said base plate and covering said opening for limiting the movement of said plug from said base plate.

4. The pump of claim 1 wherein:

said biasing means comprises an elastomeric ring normally compressed against said base plate and an annular nut which engages with said open ended tube, said annular nut serving to maintain said elastomeric ring tightly pressed against said base plate.

5. The pump of claim 4 wherein:

said annular nut is adjustable and is adjusted such that said base plate will be displaced sufficiently at said closed position to allow fluid to flow from said high pressure reservoir to said low pressure chamber upon the pressure inside said high pressure reservoir exceeding a specified level.

6. The pump of claim 1 wherein:

said open ended tube having bleed ducts which permit flow of fluid from said grooves into said low pressure chamber.

* * * * *